US006382991B2

(12) United States Patent
Kumakura et al.

(10) Patent No.: US 6,382,991 B2
(45) **Date of Patent: *May 7, 2002**

(54) LOW INSERTION FORCE CONNECTOR

(75) Inventors: Hideto Kumakura; Yuji Hatagishi; Shinji Kodama, all of Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/252,234

(22) Filed: Feb. 18, 1999

(30) Foreign Application Priority Data

Feb. 19, 1998 (JP) ..... 10-037088

(51) Int. Cl.[7] ..... H01R 13/62

(52) U.S. Cl. ..... 439/157; 439/153

(58) Field of Search ..... 439/157, 152, 439/347, 345, 247, 248, 296, 297, 310, 159

(56) References Cited

FOREIGN PATENT DOCUMENTS

JP 6-62408 9/1994

*Primary Examiner*—Gary Paumen
*Assistant Examiner*—Alexander Gilman
(74) *Attorney, Agent, or Firm*—Armstrong, Westerman, Hattori, McLeland & Naughton, LLP

(57) ABSTRACT

A low insertion force connector with a downsized and simple structure and high reliability is provided, wherein coupled connectors are capable of sufficiently moving in the uncoupling direction. The low insertion force connector includes: a first connector having a first cam-projection, a frame with a cam-opening to slidably accommodate the first connector in the coupling direction, a second connector with a coupling portion and a cam-engaging slit to be couples with the first connector in the frame, and a slider attached to the second connector, provided with a second cam-projection which engages both of the cam-opening and the cam-engaging slit, and provided with a cam groove consisting of a connector coupling cam groove and a shift-allowing cam groove continuing to the connector coupling cam groove. Thus, a low insertion force connector with a downsized and simple structure and high reliability can be realized.

17 Claims, 11 Drawing Sheets

LOW INSERTION FORCE CONNECTOR

BACKGROUND OF THE INVENTION

1. Field of the Invention

The present invention generally relates to a low insertion force connector (hereinafter "LIF connector") and more particularly, to a LIF connector wherein a low insertion force mechanism (hereinafter "LIF mechanism") is made up of a frame and a slider so as to facilitate coupling and uncoupling of connectors, i.e. multipolar connectors, each having a number of electric terminals and movability of connectors in a coupling direction has been improved.

2. Description of the Related Art

Multipolar connectors each having a number of electric terminals need large force to couple and to uncouple them, thereby making the coupling and uncoupling operation of the multipolar connectors difficult.

In view of this difficulty, a number of LIF connectors with the above-described LIF mechanism have been proposed.

In case of mounting a LIF connector on a vehicle body panel or the like (not shown), a holding structure conventionally applied to multipolar connectors in order to fix them in a coupling direction thereof is required.

FIG.24 shows a prior art holding structure of a vehicle lamp disclosed in Japanese Utility Model Registration Application Laid-open No.6-62408 (hereinafter "JUM'408"), wherein a connector 1 held by a lamp (not shown) and another connector 2 capable of coupling to the connector 1 are held by a vehicle body panel or the like 3 so as to mount the lamp (not shown) on the vehicle body panel or the like 3 and simultaneously to couple the connectors 1,2. The connector 2 of JP'408 is provided with elastic pieces 6 each having a lance 5 and each engaging an inner periphery of a connector holding opening 4 formed on the lamp (not shown) on the vehicle body panel or the like 3.

Also, four abutting pieces 7 opposite to the lances 5 are formed on the connector 2. And, the connector 2 is held elastically and movably in both vertical and horizontal directions in the connector holding opening 4 by both of the lances 5 and four abutting pieces 7. Reference numeral 8 indicates a rubber packing.

In the above-described prior art, the lances 5 correct the vertical position, i.e. in an arrow R direction, of the coupled connectors 1,2, and four abutting pieces 7 correct the axial position, i.e. in the coupling direction shown with an arrow S, of the coupled connectors 1,2.

With respect to the above prior art LIF connector of JUM'408, however, the provision of the lances 5 and the abutting pieces 7 makes the LIF connector large-sided, which goes against a space-saving movement strongly propelled in vehicle manufacturers and the like.

And, the provision of the lances 5 and the abutting pieces 7 on the connector 2 also makes the connector 2 itself and a structure of a metallic mold complicated, thereby undesirably affecting the cost and mounting workability.

Further, there is a drawback that lances 5 and the abutting pieces 7 get in contact with a wiring harness or with other parts (not shown) and then each one or either one gets damaged.

Still further, the abutting piece 7 would not bear large force in the coupling direction S, thereby lacking reliability.

SUMMARY OF THE INVENTION

In view of the foregoing, an object of the present invention is to provide a LIF connector with a downsized and simple structure and high reliability, wherein completely coupled connectors are capable of sufficiently moving in the uncoupling direction.

In order to achieve the above-described object, as a first aspect of the present invention, a LIF connector consists of: a first connector; a second connector to be coupled with the first connector; and a coupling operation member which promotes coupling of the first connector and the second connector and enables the first connector and the second connector in a state of complete coupling to move in an uncoupling direction thereof.

According to the above-described structure, the LIF connector enables the first and the second connectors in a state of complete coupling to fully move in the uncoupling direction by means of the coupling operation member.

As a second aspect of the present invention, in the LIF connector with the first aspect, each of the first connector, the second connector, and the coupling operation member is provided with a coupling promoting portion.

According to the above-described structure, various types of LIF connector can be obtained by suitably changing the coupling promoting portions.

As a third aspect of the present invention, in the LIF connector with the second aspect, the coupling promoting portion of the coupling operation member is provided with a cam groove having a connector coupling cam groove, with which the coupling promoting portion of one of the first and the second connectors slidingly engages until the complete coupling of the first and the second connectors, and a shift-allowing cam groove extending form the connector coupling cam groove in a direction orthogonal to the uncoupling direction and enabling the first and the second connectors in the completely coupled state to move in the uncoupling direction.

According to the above-described structure, since the coupling promoting portion of the coupling operation member is provided with the cam groove, the completely coupled connectors can move in the uncoupling direction even without a lance, an abutting piece or the like as a holding member conventionally used, thereby attaining a downsized and simple structure.

Also, the elimination of the lance, the abutting piece or the like dissolves a problem of their damage usually occurred, thereby attaining very high reliability.

As a fourth aspect of the present invention, in the LIF connector with the third aspect, the coupling operation member consists of a slider having the cam groove and mounted on the coupling promoting portion of the other one of the first and the second connectors and a frame to accommodate the first and the second connectors in the completely coupled state movably in the uncoupling direction and to drive the slider.

According to the above-described structure, since the slider is driven by the frame, coupling of the connectors can be done with good workability and the LIF connector can be constructed with a small number of members.

As a fifth aspect of the present invention, in the LIF connector with the fourth aspect, the coupling promoting portion of one of the first and the second connectors is a first cam-projection projecting from a housing of the one of the first and the second connectors, a coupling promoting portion of the slider is a second cam-projection to make the first cam-projection slidingly engage the cam groove, and a coupling promoting portion of the frame is a cam portion to slidingly engage the second cam-projection.

According to the above-described structure, similarly to the above, the completely coupled connectors can move in the uncoupling direction even without a lance, an abutting piece or the like as a holding member conventionally used, thereby attaining a downsized and simple structure.

Also, the elimination of the lance, the abutting piece or the like dissolves a problem of their damage usually occurred.

Further, with the above-described structure, costs and assembling workability can be remarkably improved, and the coupled connectors can bear big force, if happened, in the coupling direction by means of the cam portion, thereby attaining very high reliability.

As a sixth aspect of the present invention, in the LIF connector with the fourth aspect, the coupling promoting portion of one of the first and the second connectors is a first cam-projection projecting from a housing of the one of the first and the second connectors, a coupling promoting portion of the frame is a second cam-projection to make the first cam-projection slidingly engage the cam groove, and a coupling promoting portion of the slider is a cam portion to slidingly engage the second cam-projection.

According to the above-described structure, similarly to the above, the completely coupled connectors can move in the uncoupling direction even without a lance, an abutting piece or the like as a holding member conventionally used, thereby attaining a downsized and simple structure.

Also, the elimination of the lance, the abutting piece or the like dissolves a problem of their damage usually occurred.

Further, with the above-described structure, costs and assembling workability can be remarkably improved, and the coupled connectors can bear big force, if happened, in the coupling direction by means of the cam portion, thereby attaining very high reliability.

As a seventh aspect of the present invention, in the LIF connector with any one of the fourth to sixth aspects, the coupling promoting portion of the other one of the first and the second connectors is formed to enable the slider to slide in a direction orthogonal to the uncoupling direction at the beginning of coupling of the first and the second connectors.

According to the above-described structure, since a moving range of the completely coupled first and second connectors in the uncoupling direction can be suitably set within a range decided by both of a length of the cam portion and a sliding range of the slider, the moving range can be larger than that of a conventional LIF connector with a mechanism using a lance, an abutting piece or the like.

As an eighth aspect of the present invention, in the LIF connector with the seventh aspect, the coupling promoting portion of the other one of the first and the second connectors is a cam-engaging slit formed on a housing of the other one of the first and the second connectors.

According to the above-described structure, since the slider shifts with respect to the cam-engaging slit, the LIF connector has been simply constructed.

As a ninth aspect of the present invention, in the LIF connector with the second aspect, the coupling promoting portion of one of the first and the second connectors is provided with a cam groove having a connector coupling cam groove, with which the coupling promoting portion of the coupling operation member slidingly engages until the complete coupling of the first and the second connectors, and a shift-allowing cam groove extending form the connector coupling cam groove in a direction orthogonal to the uncoupling direction and enabling the first and the second connectors in the completely coupled state to move in the uncoupling direction.

According to the above-described structure, since the coupling promoting portion of one of the first and the second connectors is provided with the cam groove, the completely coupled connectors can move in the uncoupling direction even without a lance, an abutting piece or the like as a holding member conventionally used, thereby attaining a downsized and simple structure.

Also, the elimination of the lance, the abutting piece or the like dissolves a problem of their damage usually occurred, thereby attaining very high reliability.

As a tenth aspect of the present invention, in the LIF connector with the ninth aspect, the coupling operation member consists of a slider having a coupling promoting portion corresponding to the cam groove and mounted on the coupling promoting portion of the other one of the first and the second connectors and a frame to accommodate the first and the second connectors in the completely coupled state movably in the uncoupling direction and to drive the slider.

According to the above-described structure, since the slider is driven by the frame, coupling of the connectors can be done with good workability and the LIF connector can be constructed with a small number of members.

As an eleventh aspect of the present invention, in the LIF connector with the tenth aspect, the coupling promoting portion of the slider is provided with a first cam-projection to slidingly engage the cam groove and a second cam-projection to make the first cam-projection slidingly engage the cam groove, and a coupling promoting portion of the frame is a cam portion to slidingly engage the second cam-projection.

According to the above-described structure, similarly to the above, the completely coupled connectors can move in the uncoupling direction even without a lance, an abutting piece or the like as a holding member conventionally used, thereby attaining a downsized and simple structure.

Also, the elimination of the lance, the abutting piece or the like dissolves a problem of their damage usually occurred.

Further, with the above-described structure, costs and assembling workability can be remarkably improved, and the coupled connectors can bear big force, if happened, in the coupling direction by means of the cam portion, thereby attaining very high reliability.

As a twelfth aspect of the present invention, in the LIF connector with the tenth aspect, the coupling promoting portion of the slider is provided with a first cam-projection to slidingly engage the cam groove and a cam portion, and a coupling promoting portion of the frame is a second cam-projection to slidingly engage the cam portion and to thereby make the first cam-projection slidingly engage the cam groove.

According to the above-described structure, similarly to the above, the completely coupled connectors can move in the uncoupling direction even without a lance, an abutting piece or the like as a holding member conventionally used, thereby attaining a downsized and simple structure.

Also, the elimination of the lance, the abutting piece or the like dissolves a problem of their damage usually occurred.

Further, with the above-described structure, costs and assembling workability can be remarkably improved, and the coupled connectors can bear big force, if happened, in the coupling direction by means of the cam portion, thereby attaining very high reliability.

As a thirteenth aspect of the present invention, in the LIF connector with any one of the tenth to twelfth aspects, the coupling promoting portion of the other one of the first and the second connectors is formed to enable the slider to slide in a direction orthogonal to the uncoupling direction at the beginning of coupling of the first and the second connectors.

According to the above-described structure, since a moving range of the completely coupled first and second connectors in the uncoupling direction can be suitably set within a range decided by both of a length of the cam portion and a sliding range of the slider, the moving range can be larger than that of a conventional LIF connector with a mechanism using a lance, an abutting piece or the like.

As a fourteenth aspect of the present invention, in the LIF connector with the thirteenth aspect, the coupling promoting portion of the other one of the first and the second connectors is a cam-engaging slit formed on a housing of the other one of the first and the second connectors.

According to the above-described structure, since the slider shifts with respect to the cam-engaging slit, the LIF connector has been simply constructed.

As a fifteenth aspect of the present invention, in the LIF connector with the second aspect, the first connector, the second connector, and the coupling operation member each have two of the coupling promoting portion.

According to the above-described structure, coupling operation of the first and the second connectors can be done with a smaller force and also coupling stability therebetween increases.

As a sixteenth aspect of the present invention, in the LIF connector with either one of the fourth aspect or the tenth aspect, the first connector is provided with a sliding strip and the frame is provided with a sliding groove which engages the sliding strip so as to guide the first connector in an axial direction.

According to the above-described structure, the first connector can be inserted into the frame smoothly and stable and vertical position of the first connector can be fixed in the frame.

As a seventeenth aspect of the present invention, in the LIF connector with either one of the fourth aspect or the tenth aspect, the first connector is provided with an engaging projection and the frame is provided with an engaging nail so as to catch the first connector on coupling of the first connector and the second connector by making the engaging projection abut against the engaging nail.

According to the above-described structure, an axial position of the first connector can be fixed when the second connector is coupled to the first connector, thereby ensuring stable and sure coupling operation.

The above and other objects and features of the present invention will become more apparent from the following description taken in conjunction with the accompanying drawings.

DESCRIPTION OF THE PREFERRED EMBODIMENTS

Embodiments of the present invention will now be described in further detail with reference to the accompanying drawings.

Directions of "up and down", "right and left", and "back and forth" in the description hereinafter corresponds to each drawing.

Figure 1:
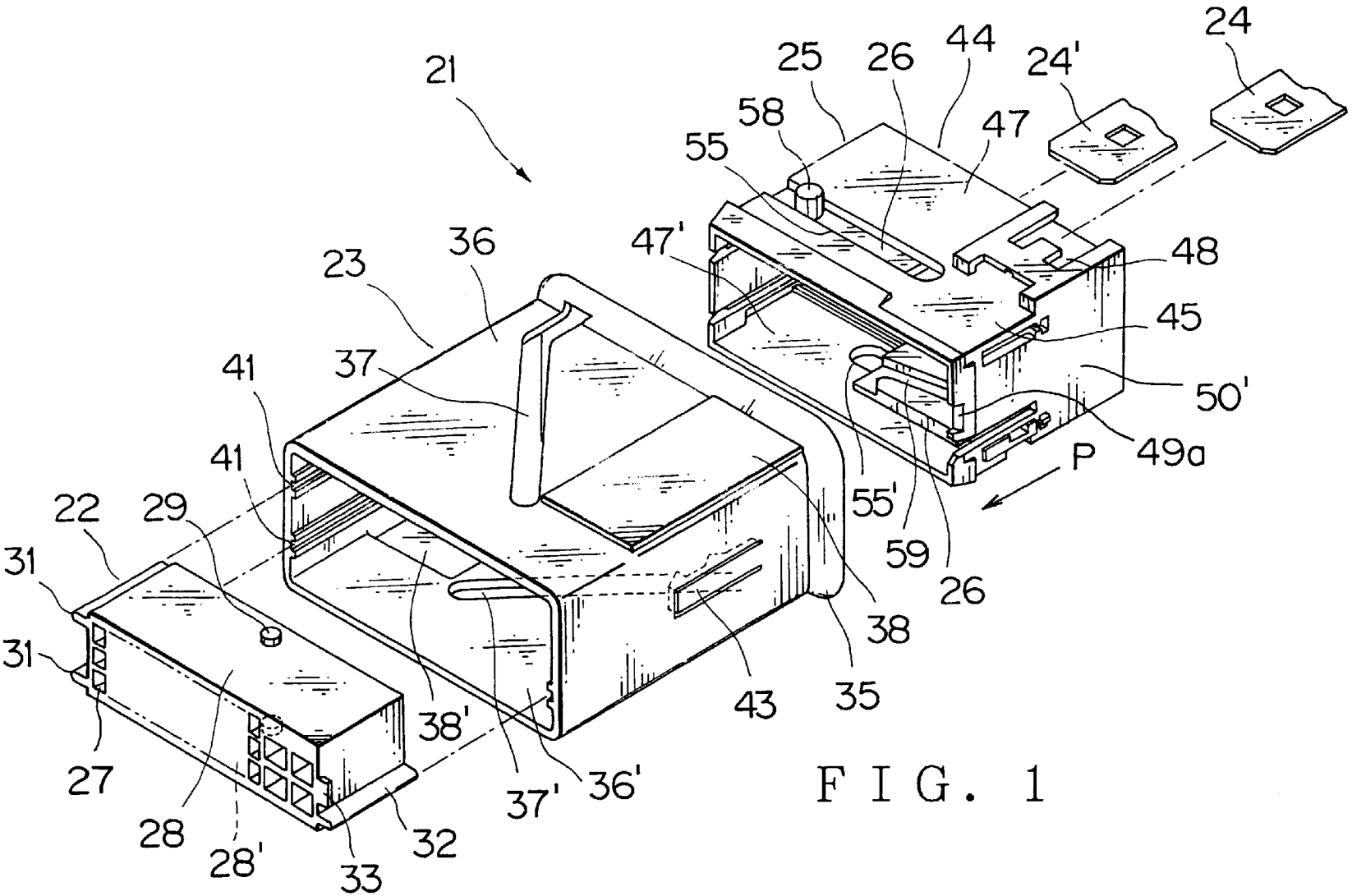
FIG. 1 is an exploded perspective view showing an embodiment of a LIF connector in accordance with the present invention.

Referring to FIG. 1, a reference numeral 21 indicates a low insertion force connector (hereinafter "LIF connector") having a LIF mechanism. The LIF connector 21 is composed of a first connector 22, a frame 23 (a coupling operation member, a LIF mechanism) accommodating the first connector 22 and fixed to a vehicle body panel or the like (not shown), a second connector 25, to which attaching portions 24,24', for example, of a lamp (not shown) is fixed, to be coupled with the first connector 22 in the frame 23, and sliders 26,26 (a coupling operation member, a LIF mechanism) to be mounted to the second connector 25, all of which are made of synthetic resin.

Figure 2:
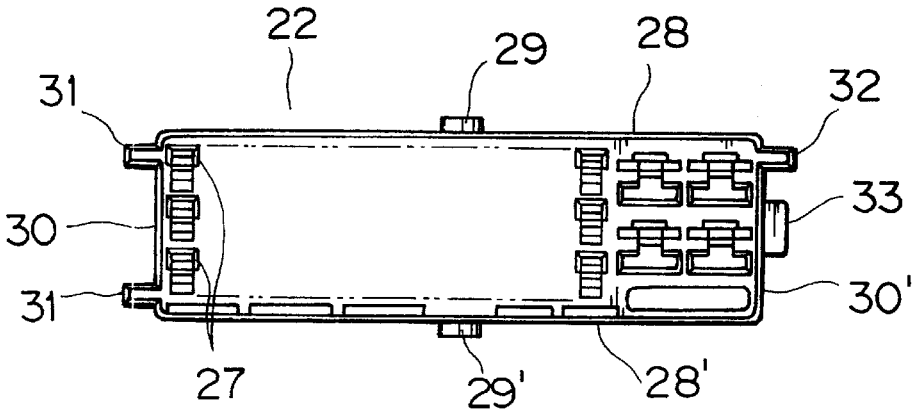
FIG. 2 is a front view of a first connector shown in FIG. 1.
Figure 3:
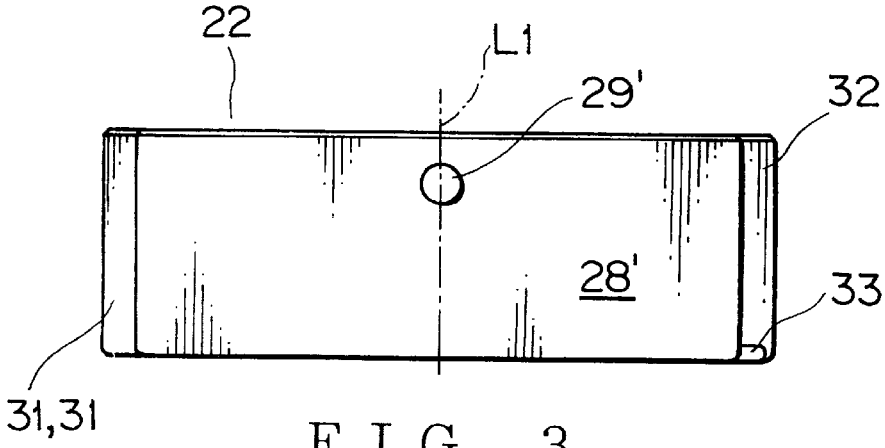
FIG. 3 is a top view of a first connector shown FIG. 1.
Figure 4:
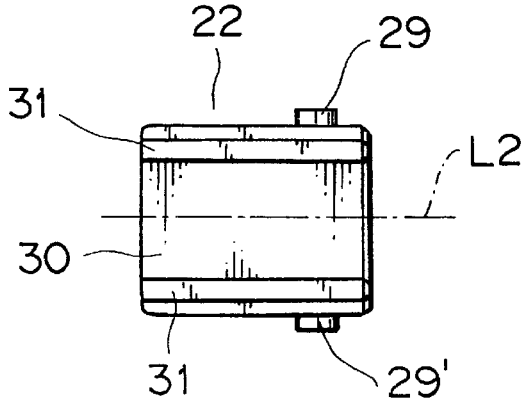
FIG. 4 is a side view of a first connector shown in FIG. 1.

The first connector 22 has a substantially rectangular cross-section and has a plurality of terminal accommodating chambers 27 corresponding to electric terminals (not shown). As shown in FIGS. 2 to 4, first cam-projections 29,29'(a coupling promoting portion) in a cylindrical shape project outwardly from up-and-down side walls 28,28'(both side walls of a housing) of the first connector 22.

The first cam-projections 29,29' are provided on an axis L1 of the first connector 22 and near a coupling side to the second connector 25(FIG. 1).

On the other hand, a left side wall 30 perpendicular to the up-and-down side walls 28,28' is provided with a pair of sliding strips 31,31 relative to the frame 23. Also, a right side wall 30' opposite to the left side wall 30 is provided with a single sliding strips 32 and an engaging projection 33 relative to an engaging nail 43 (described later) of the frame 23.

The sliding strips 31,31 are arranged vertically symmetrically each other with respect to an axis L2, and one of the sliding strips 31,31 and a sliding strip 32 on the right side wall 30' are arranged horizontally symmetrically each other with respect to the axis L1 of the first connector 22. The engaging projection 33 projects on an end portion to which the plurality of electric terminals (not shown) are inserted.

Figure 5:
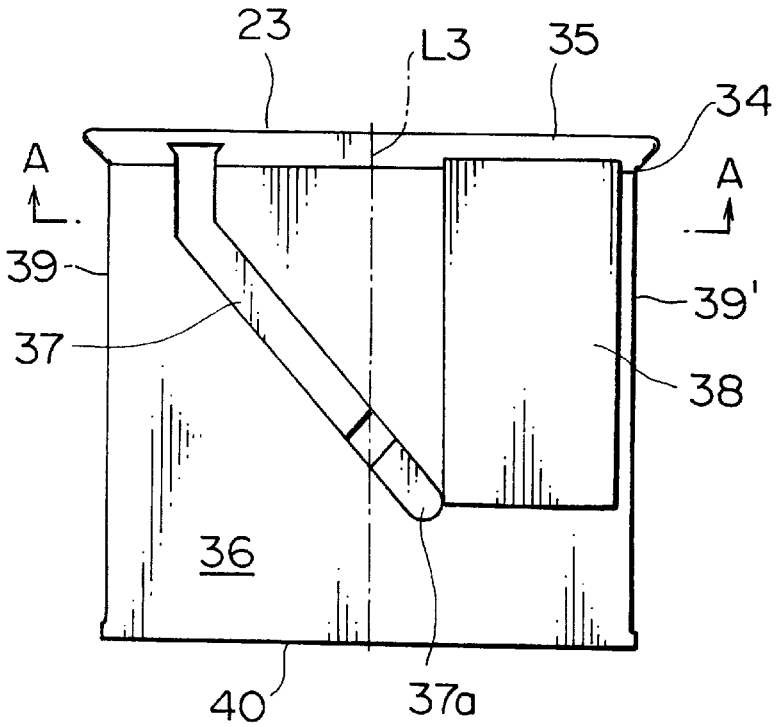
FIG. 5 is a top view of a frame shown in FIG. 1.
Figure 6:
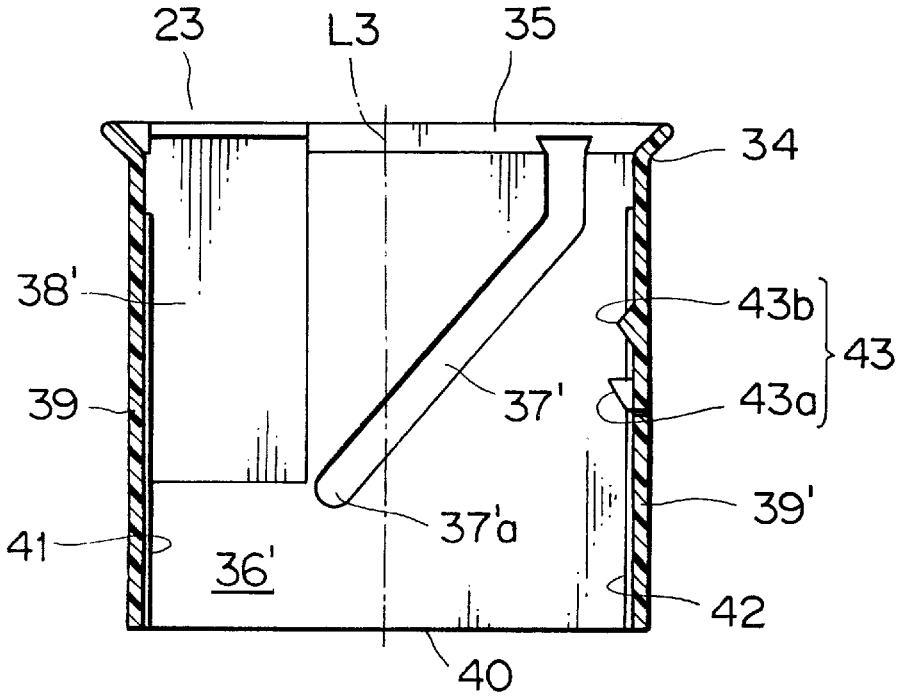
FIG. 6 is a sectional view of the frame of FIG. 5.
Figure 7:
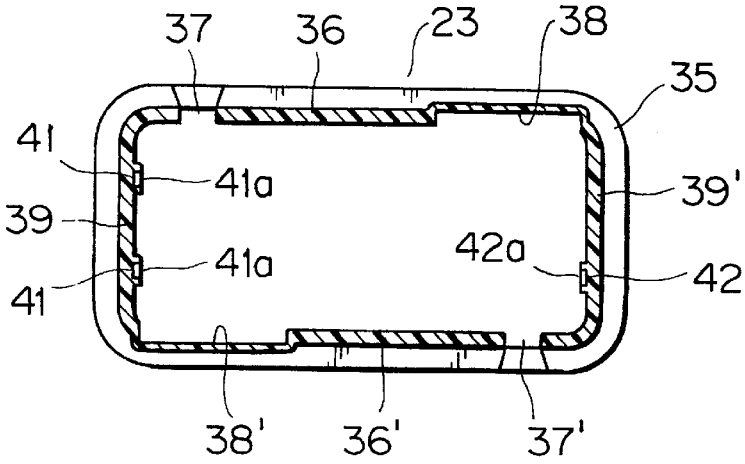
FIG. 7 is a sectional view taken along a line A—A in FIG. 5.

As shown in FIGS. 5 to 7, the frame 23 is formed to a rectangular tube and is provided with a brim portion 35 widening outwardly on one edge 34 from which the second connector 25 is inserted. The other edge 40 (described later) of the frame 23 is fixed to a vehicle body panel or the like (not shown).

The up-and-down side walls 36,36' of the frame 23, to face the up-and-down side walls 28,28'(FIG. 2) of the first connector 2 upon accommodation thereof, are provided with cam-openings 37,37'(a cam portion or a coupling promoting portion; not only a opening but also a groove being applicable) symmetrically with each other with respect to an axis L3 of the frame 23 and are provided with concaves 38,38'(hollows on an inner surface of the frame) corresponding to engaging portions 48,48'(described later) of the second connector 25.

As shown in FIG. 5, the cam-opening 37 is notched from the brim portion 35 near the left side wall 39 facing the left side wall 30(FIG. 2) of the first connector 22 to a direction parallel to the axis L3 of the frame 23, proceeds toward a right side wall 39' opposite to the left side wall 39 by bending approximately 40 degrees, and has a front end portion 37*a,* thereby forming an elbow-shaped bend.

Also, as shown in FIG. 6, the cam-opening 37' is formed symmetrically with the cam-opening 37 with respect to the axis L3 and has a front end portion 37'*a*.

The angle of 40 degrees may be suitably set taking coupling of a first connector and a second connector in consideration.

On the one hand, sliding grooves 41,41 corresponding to the pair of sliding strips 31,31(FIG. 2) of the first connector 22 are formed inside the left side wall 39 of the frame 23 from the other edge 40 toward the brim portion 35.

On the other hand, a sliding groove 42 corresponding to the sliding strip 32(FIG. 2) is formed inside the right side wall 39' of the frame 23.

As shown in FIG. 7, the sliding grooves 41,41,42 are provided with stoppers 41*a,*41*a,*42*a* corresponding to the first connector 22 on the side of the brim portion 35. And, an engaging nail 43 having a nail portion 43*a* and a releasing projection 43*b* both projecting inwardly is provided in the middle portion of the right side wall 39' as shown in FIG. 6.

Figure 8:
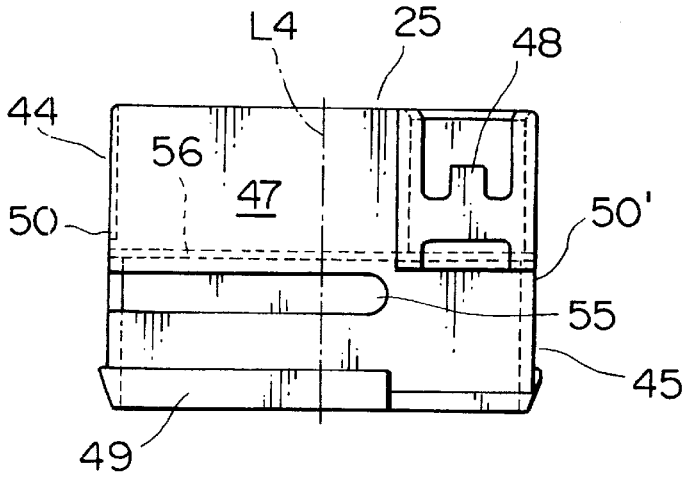
FIG. 8 is a top view of a second connector shown in FIG. 1.
Figure 9:
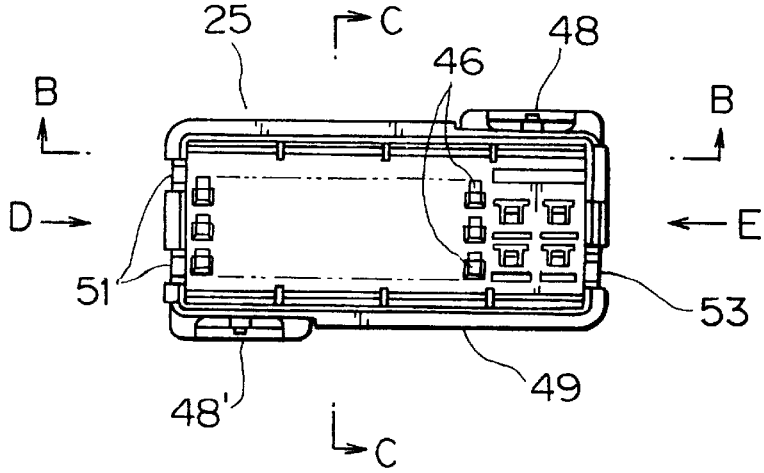
FIG. 9 is a front view of a second connector shown in FIG. 1.
Figure 10:
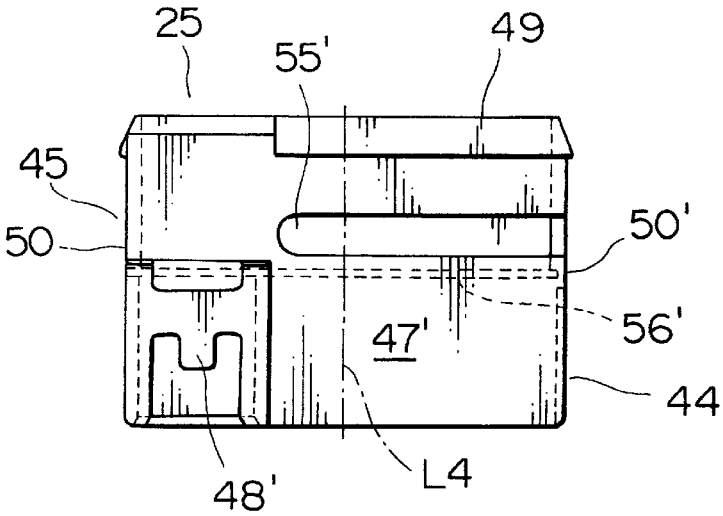
FIG. 10 is a bottom view of a second connector shown in FIG. 1.

As shown in FIGS. 8 to 10, the second connector 25 has a substantially rectangular cross-section and consists of a terminal accommodating portion 44 and a coupling portion 45.

The terminal accommodating portion 44 is provided with a plurality of terminal accommodating chambers 46 in which electric terminals 44*a*(FIG. 20) corresponding to the plurality of electric terminals (not shown) accommodated in the first connector 22 are accommodated.

Further, the terminal accommodating portion 44 is provided with engaging portions 48,48' corresponding to the attaching portions 24,24' on the up-and-down side walls 47,47' facing the up-and-down side walls 36,36'(FIGS. 5 and 6) of the frame 23.

The engaging portions 48,48' are located symmetrically with each other with respect to an axis L4 of the second connector 25 and has a height to be accommodated in the concave 38,38' of the frame 23.

On the other hand, the coupling portion 45 has a space capable of accommodating the first connector 22 and the sliders 26,26 and is provided with a tapered brim portion 49 on an end periphery on the side of receiving the first connector 22.

Figure 11:
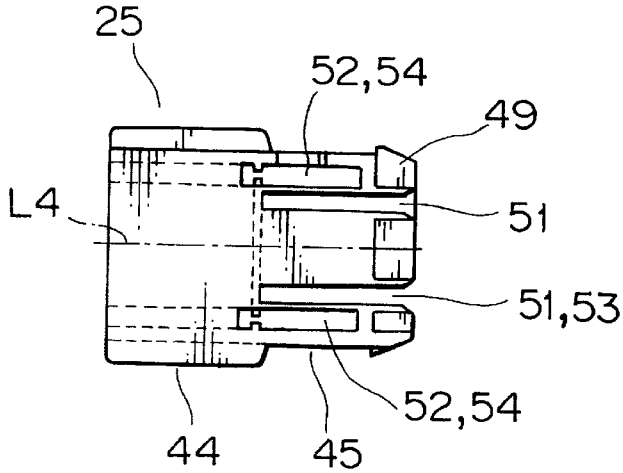
FIG. 11 is a side view of the second connector from a D-direction in FIG. 9.

And, side slits 51,51(FIGS. 9 and 11) corresponding to the sliding strips 31,31 of the first connector 22 and slots 52,52(FIG. 11) corresponding to the sliders 26,26 are formed on the left side wall 50, corresponding to the left side wall 30(FIG. 2) of the first connector 22, of the second connector 25. Also, side slit 53 and slots 54,54 are formed on the right side wall 50' facing the left side wall 50.

Further, the coupling portion 45 is provided with cam-engaging slits 55,55'(a coupling promoting portion) corresponding to second cam-projections 58,58(described later) of the sliders 26,26 on the up-and-down side walls 47,47'.

The cam-engaging slit 55 is notched from the left side wall 50 to a direction of the axis L4 of the second connector 25, and also the cam-engaging slit 55' is notched from the right side wall 50' to a direction of the axis L4 of the second connector 25.

Figure 12:
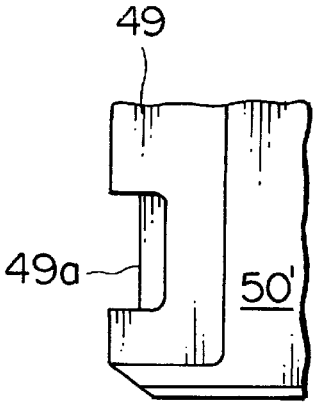
FIG. 12 is a side view of the second connector from a E-direction in FIG. 9.

As shown in FIG. 12, the second connector 25 is provided with an engagement releasing portion 49*a,* corresponding to the releasing projection 43*b*(FIG. 6) of the frame 23, in a shape of recess on the brim portion 49 of the right side wall 50'. And, the second connector 25 is provided with rails 56,56'(FIGS. 8 and 10), corresponding to the sliders 26,26 and perpendicular to the axis L4, inside thereof.

Figure 13:
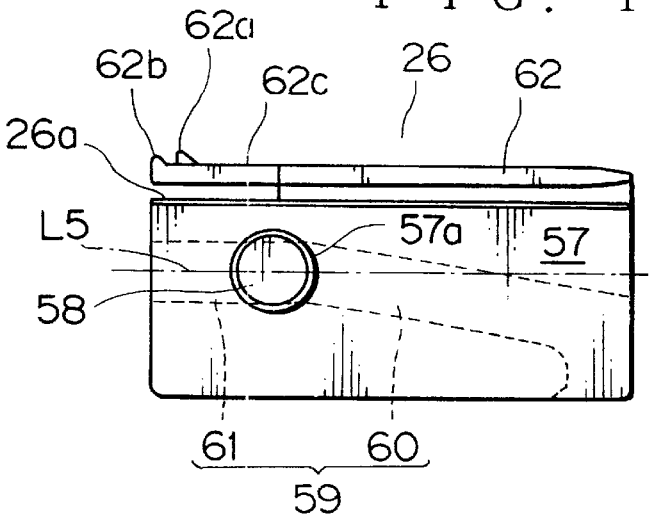
FIG. 13 is a top view of a slider shown in FIG. 1.
Figure 16:
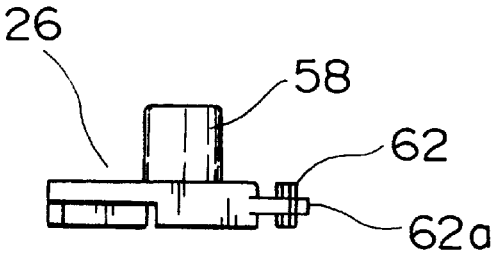
FIG. 16 is a side view of a slider shown in FIG. 1.

The slider 26 is formed in a shape of a rectangular plate as shown in FIGS. 13 and 16. And, the slider 26 is provided, on one side surface 57 thereof, with a second cam-projection 58(a coupling promoting portion) in a cylindrical shape to slidingly engage with the cam-engaging slit 55 or 55'(FIGS. 8 and 10) of the second connector 25 and with the cam-opening 37 or 37'(FIGS. 5 and 6) of the frame 23 and is provided, on the other side surface 57' thereof, with a cam groove 59(a coupling promoting portion; not only a groove but also a cam-engaging slit being applicable) corresponding to the first cam-projection 29 or 29'(FIG. 2) of the first connector 22.

Figure 14:
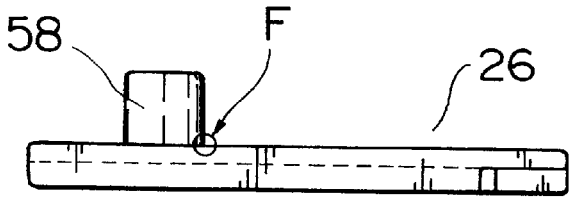
FIG. 14 is a front view of a slider shown in FIG. 1.
Figure 15:
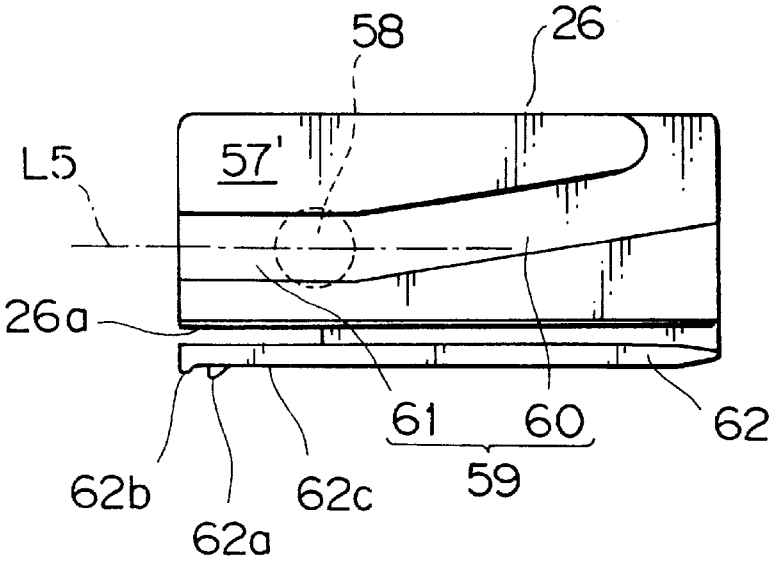
FIG. 15 is a bottom view of a slider shown in FIG. 1.

The second cam-projection 58 is provided with a groove 57*a*(FIG. 13) around a bottom portion thereof, namely at F portion of FIG. 14. And, the cam groove 59 consists of a connector coupling cam groove 60, which slidingly engages the first cam-projection 29 or 29'(FIG. 2) until the first connector 22 completely couples to the second connector 25 by slide of the second cam-projection 58, and a shift-allowing cam groove 61 continuing to the connector coupling cam groove 60 and allowing the completely coupled first and second connectors 22,25 to shift in a coupling direction P(FIG. 1). As shown in FIG. 13 or FIG. 15, the connector coupling cam groove 60 leans against an axis L5, and the shift-allowing cam groove 61 is in parallel to the axis L5.

Further, the slider 26 is axially provided with a rail sliding portion 62 which slides in the rail 56 or 56'(FIGS. 8 and 10) of the second connector 25 at one edge 26'a.

The rail sliding portion 62 is provided with a stopper 62*a* in a nail-like shape and a projection 62*b* both at one end portion 62*c*. And, a space is formed between the one end portion 62*c* and the one edge 26*a* for giving resilience to the one end portion 62*c*.

Hereinafter, an assembling process of the LIF connector 21 is described.

First, a process of attaching the slider 26 to the second connector 25 is described referring to FIGS. 17 to 20.

Figure 17:
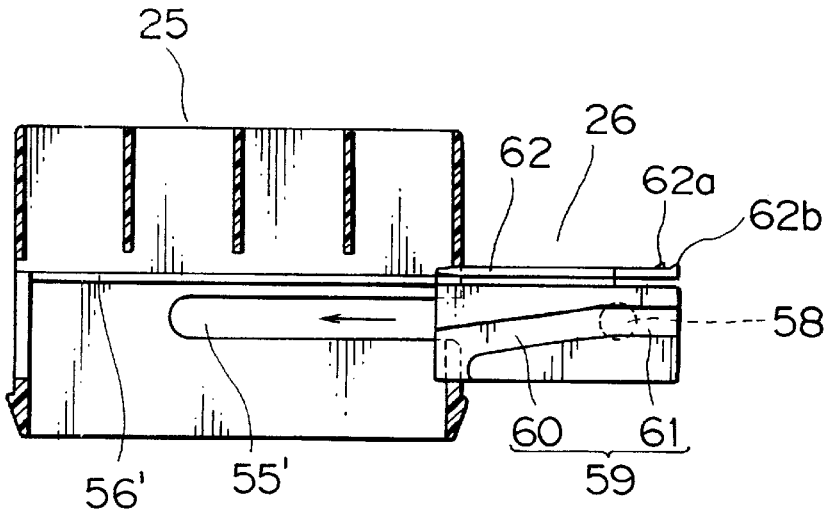
FIG. 17 is a sectional view taken along a line B—B in FIG. 9, showing a state of the beginning of mounting the slider on the second connector.

As shown in FIG. 17, the slider 26 is inserted in one of the slots 54,54(FIG. 11) of the second connector 25, and then the rail sliding portion 62 of the slider 26 engages the rail 56' of the second connector 25 slidably.

Figure 18:
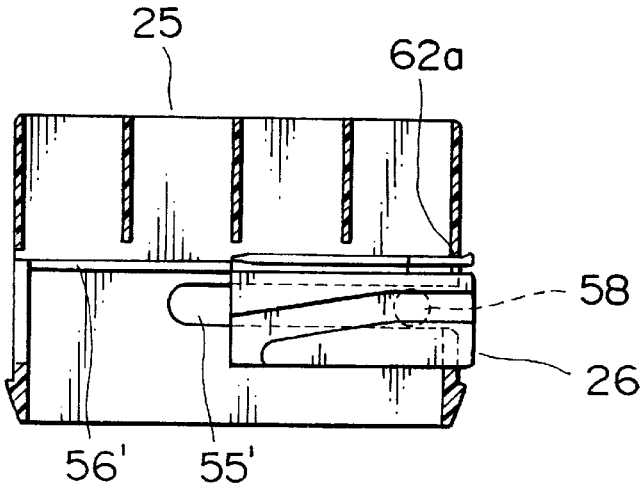
FIG. 18 is a sectional view taken along a line B—B in FIG. 9, showing a state that a stopper of the slider has entered the second connector after the state of FIG. 17.

From this state, as shown in FIG. 18, the slider 26 slides with guide of the rail 56' by pushed until the stopper 62*a* enters the second connector 25. Simultaneously, the second cam-projection 58 slides the cam-engaging slit 55' of the second connector 25.

Figure 19:
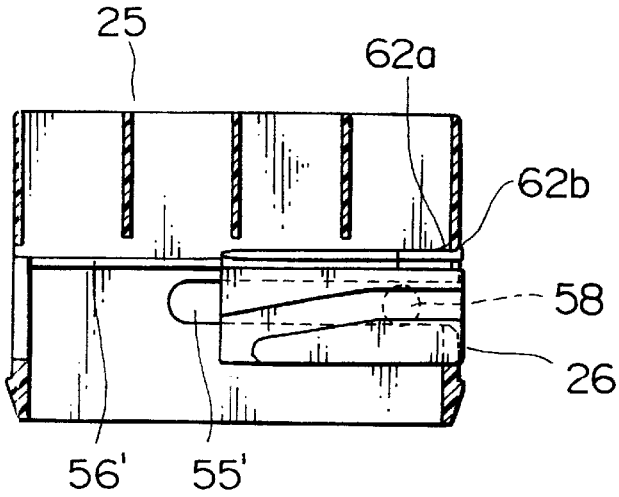
FIG. 19 is a sectional view taken along a line B—B in FIG. 9, showing a state that the slider has mounted in the second connector after the state of FIG. 18.

Then, as shown in FIG. 19, after the insertion of the stopper 62*a* into the second connector 25, the projection 62*b* abuts the right side wall 50'(FIG. 9) of the second connector 25 thereby to fix an initial location of the slider 26. The stopper 62*a* prevents the slider 26 from dropping out.

Figure 20:
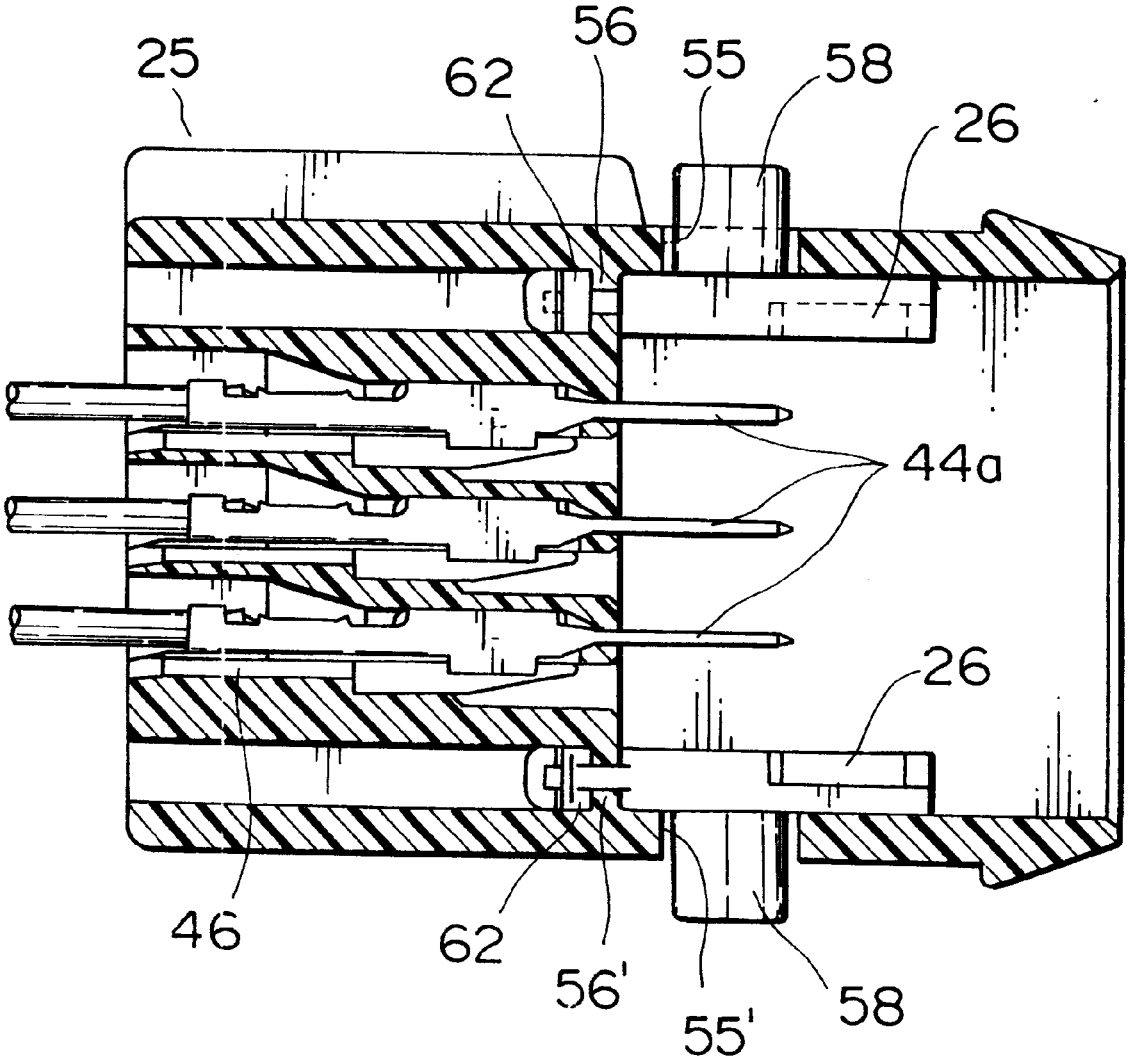
FIG. 20 is a sectional view taken along a line C—C in FIG. 9, showing a state that the slider has mounted in the second connector after the state of FIG. 18.

The sliders 26,26 are mounted in a state shown in FIG. 20 taken along a line C—C in FIG. 9. When the slider 26 is further pushed inwardly, the second cam-projection 58 slides in the cam-engaging slit 55' and abuts on an end portion of the cam-engaging slit 55', while an end of the slider 26 enters one of the slots 52,52(FIG. 11) on the left side wall 50(FIG. 9).

Further, an assembling process of the LIF connector 21 is described, referring to FIGS. 1, and 21 to 23.

Figure 21:
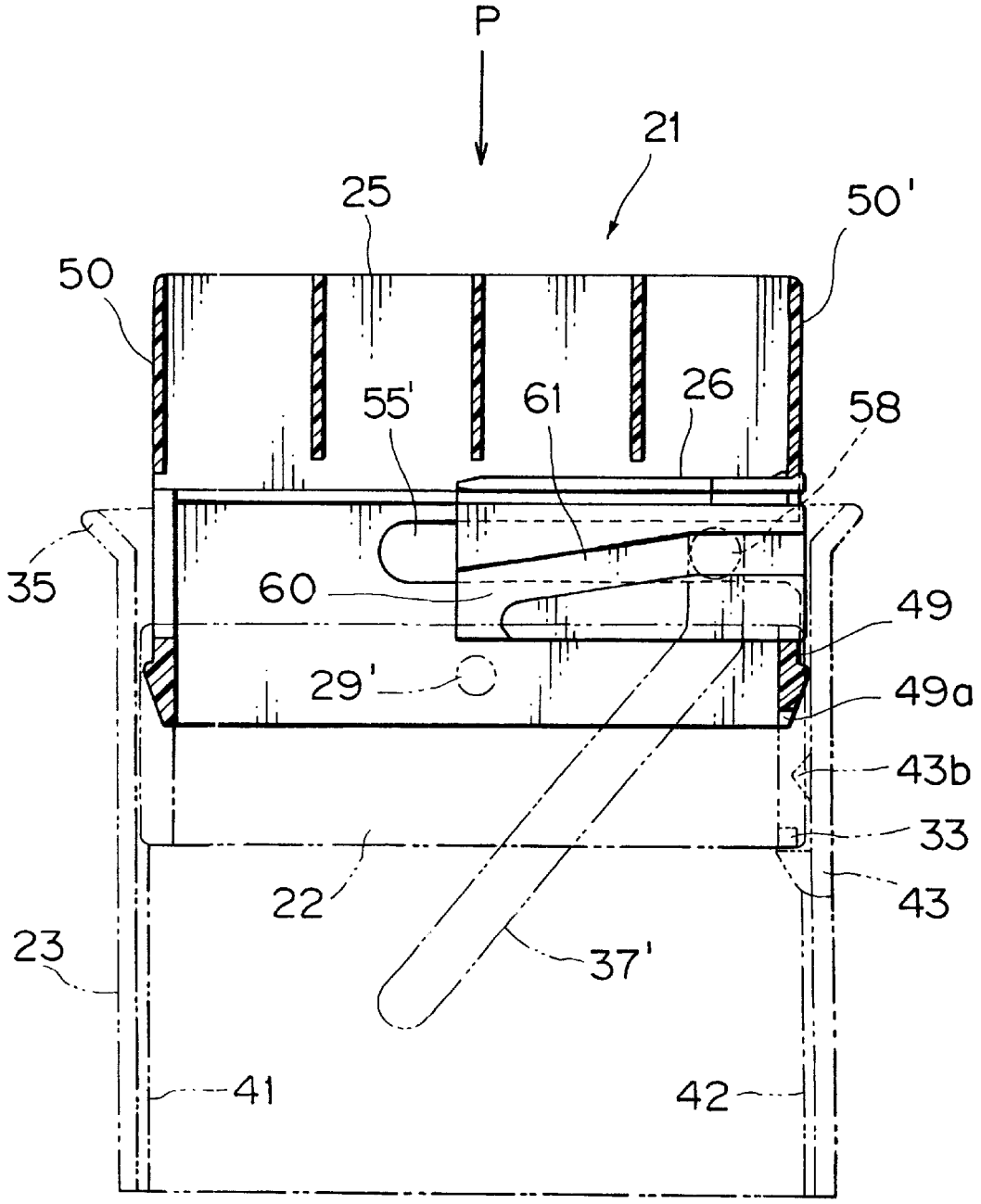
FIG. 21 is a sectional view showing a state of the beginning of coupling of the first connector and the second connector in an assembling process of the LIF connector of FIG. 1.
Figure 23:
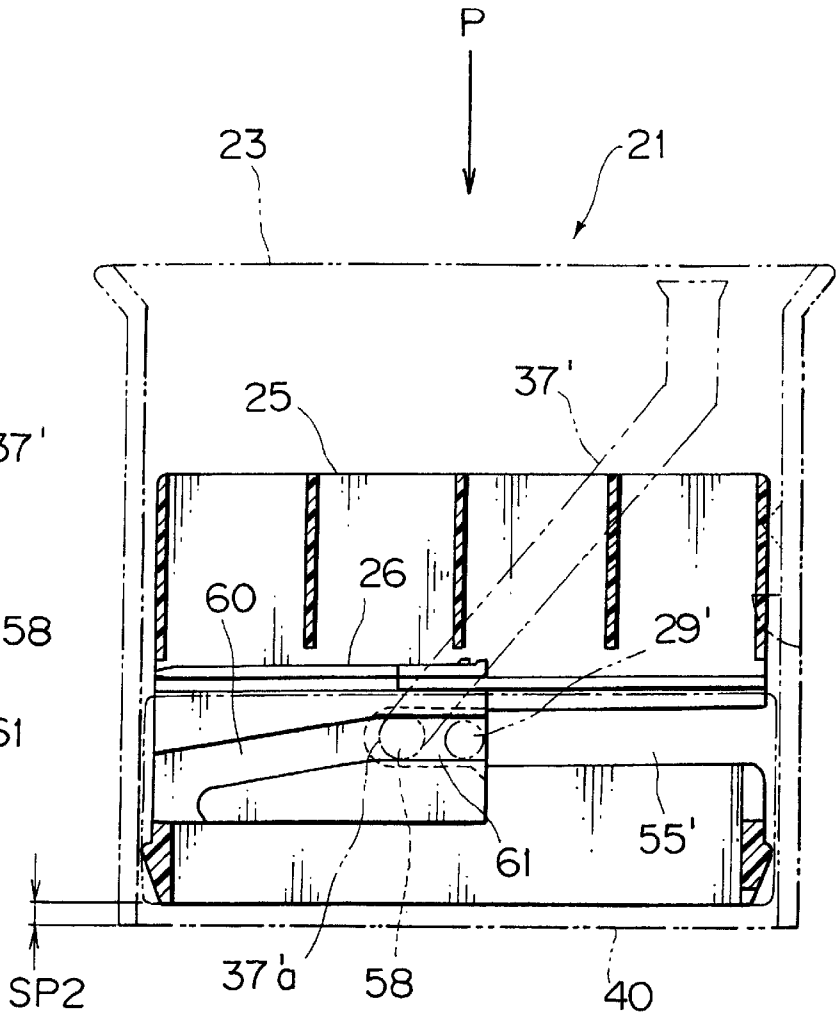
FIG. 23 is a sectional view showing a movable state of the completely coupled first and second connectors of FIG. 22 in the coupling direction.
Figure 22:
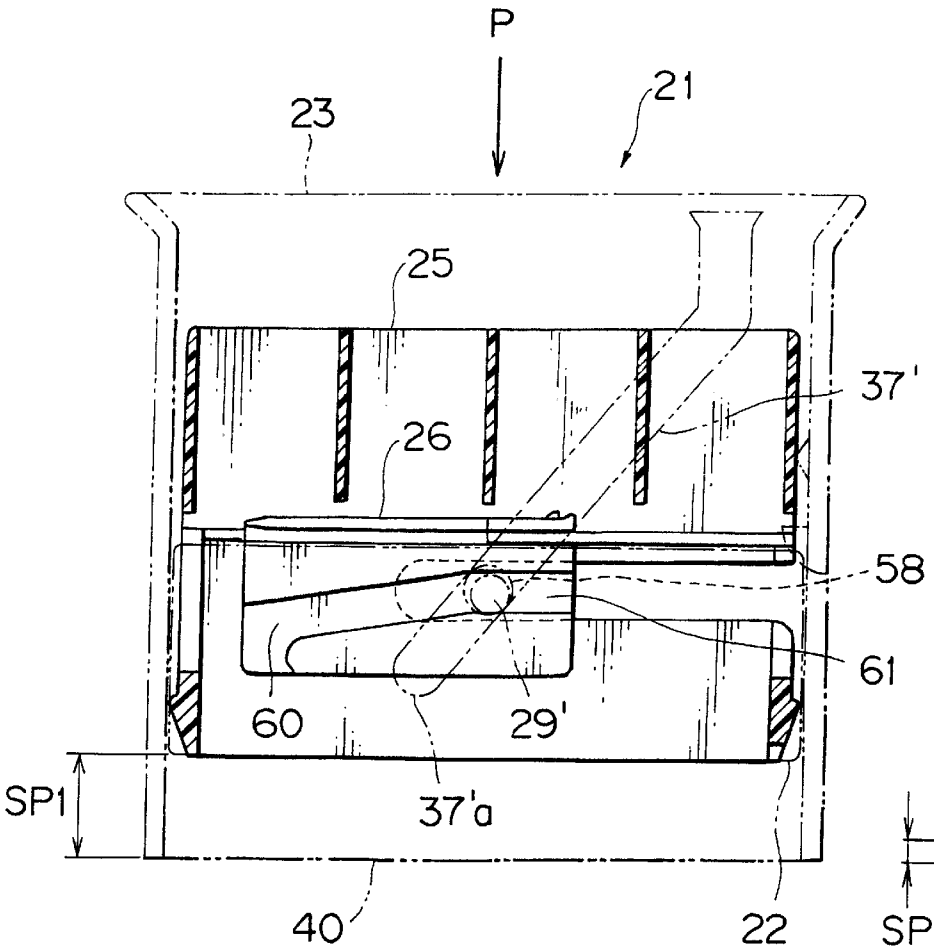
FIG. 22 is a sectional view showing a completely coupled state of the first connector and the second connector in an assembling process of the LIF connector of FIG. 1.

Here, FIGS. 21 to 23 show a state taken along the line B—B in FIG. 9 like FIGS. 17 to 19.

Referring to FIG. 1, an assembling of the LIF connector 21 completes with coupling of the first connector 22, which is accommodated in the frame 23 fixed to a vehicle body panel or the like (not shown), to the second connector 25, which is fixed to the attaching portions 24,24' of a lamp or the like (not shown) by engaging the engaging portions 48,48'(FIG. 9) to the portions 24,24', by means of engaging the sliding grooves 41,41,42 of the frame 23 with the sliding strips 31,31,32 of the first connector 22.

More specifically, as shown in FIG. 21, when the second connector 25 with the slider 26 is guided into the frame 23 by means of the sliding grooves 41,42 and coupled to the first connector 22 having the engaging projection 33 engaging the engaging nail 43 by proceeding in the coupling direction P, the second cam-projection 58 of the slider 26 starts to engage the cam-opening 37' of the frame 23.

And, as further pushing the second connector 25 in the coupling direction P, the second cam-projection 58 slides the portion, parallel to the coupling direction P, of the cam-opening 37' of the frame 23, while the first cam-projection 29' of the first connector 22 enters the connector coupling cam groove 60 of the slider 26.

In this state, the releasing projection 43*b* of the frame 23 is widened outwardly by the engagement releasing portion 49*a* formed on the brim portion 49 of the second connector 25, and then the engagement between the engaging projection 33 of the first connector 22 and the engaging nail 43 of the frame 23 is released.

As further advancing the second cam-projection 58 along a leaning portion of the cam-opening 37', the slider 26 shifts toward the left side wall 50 of the second connector 25. With this shift of the slider 26, the connector coupling cam groove 60 slidingly moves the first cam-projection 29', thereby promoting the coupling of the first connector 22 and the second connector 25.

When the first cam-projection 29' has shifted in the connector coupling cam groove 60 to a position shown in FIG. 22, the first connector 22 completely couples to the second connector 25 (a completely coupled state).

The completely coupled state leaves an interval SP1 between the other edge 40 of the frame 23 and the first connector 22.

The second cam-projection 58 can further shift in the cam-opening 37' continuously to the completely coupled state. More specifically, as shown in FIG. 23, when the second cam-projection 58 abuts the front end portion 37'*a* of the cam-opening 37', the first cam-projection 29' slidingly shifts in the shift-allowing cam groove 61 and the completely coupled first and second connectors 22,25 approach the other edge 40 of the frame 23 with leaving an interval SP2.

Namely, the completely coupled first and second connectors 22,25 can move within a distance of SP1–SP2 in the coupling direction P. This is the same for a case of detaching the connector 25.

Accordingly, if a position apart by a distance of (SP1–SP2)/2 from the completely coupled position shown in FIG. 22 is defined as a design position of the completely coupled first and second connectors 22,25, the completely coupled first and second connectors 22,25 can shift by a distance of (SP1–SP2)/2 in both the coupling direction P and the uncoupling direction (the reverse direction against P).

Figure 24:
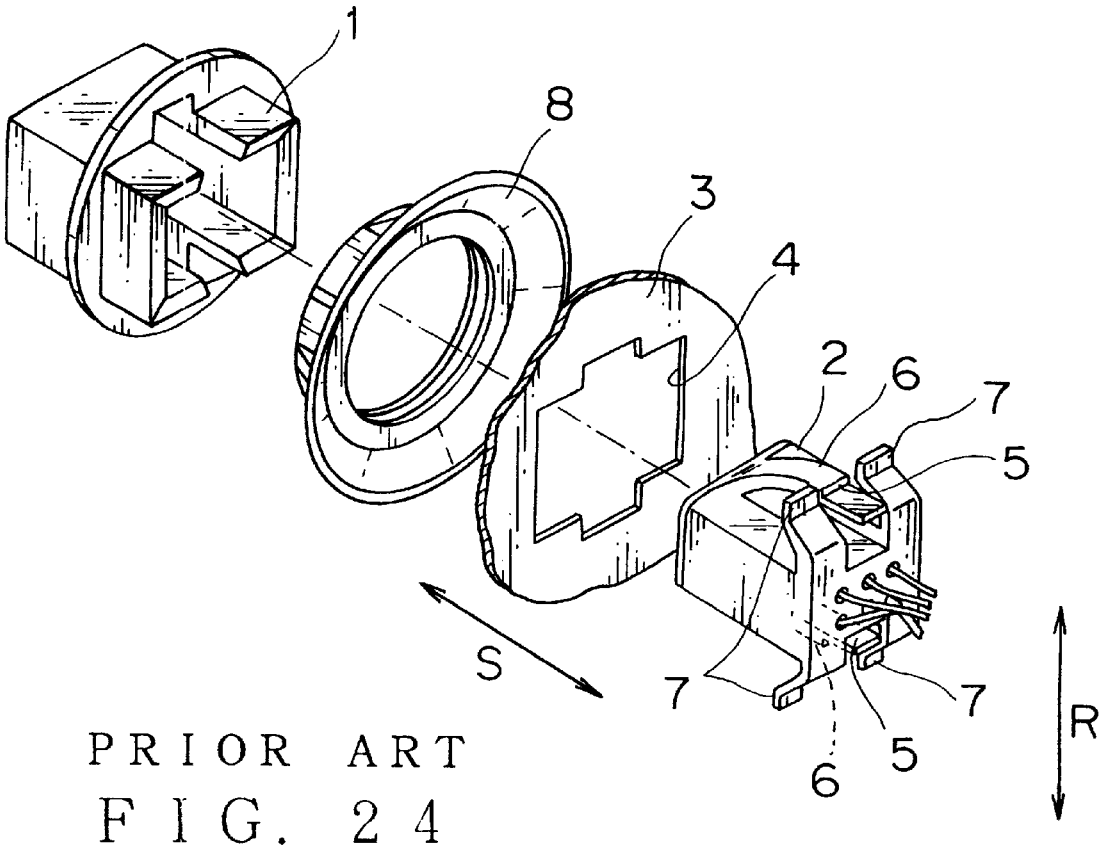
PRIOR ART FIG. 24
FIG. 24 is a perspective view showing a prior art multipolar connector with a holding member.

With the above-described structure of the LIF connector 21, the completely coupled connectors can move in the coupling direction P even without a lance, an abutting piece or the like (FIG. 24) as a holding member conventionally used, thereby attaining a downsized and simple structure. Also, the elimination of the lance, the abutting piece or the like can dissolve a problem of their damage usually occurred.

Further, with the above-described structure, costs and assembling workability can be remarkably improved. And, the coupled connectors can bear big force, if happened, in the coupling direction P, thereby attaining very high reliability.

Further, by suitably modifying form of the aforementioned members and simultaneously, for example, by adopting the following combinations, LIF connectors may be constructed.

A first modified embodiment has the same first connector and the same second connector as the aforementioned LIF connector 21, wherein a second cam-projection is provided on the frame and a cam groove and a cam portion, for example, formed with a groove instead of the cam-openings 37,37' is formed on the slider.

With this structure, when the second cam-projection of the frame slides along the cam portion of the slider, the slider shifts through the cam-engaging slit of the second connector and then the first cam-projection of the first connector starts to slide in the cam groove of the slider.

As further sliding the second cam-projection along the cam portion, the complete coupling between the first connector, which has been accommodated in the frame by the slide of the first cam-projection along the connector coupling cam groove of the cam groove, and the second connector is attained. And simultaneously, the completely coupled first and second connectors are allowed to move in the uncoupling direction by the slide of the first cam-projection in the shift-allowing cam groove of the cam groove.

As a second modified embodiment of the aforementioned LIF connector 21, the cam groove is formed on one of the up-and-down side walls of either one housing of the first connector or of the second connector and the cam-engaging slit applied to the first modified embodiment is formed on the other housing of the first connector or of the second connector. And, the frame is provided with the cam portion and the slider is provided with the first cam-projection and the second cam-projection.

With this structure, when the second cam-projection of the slider slides along the cam portion of the frame, the slider shifts through the cam-engaging slit of the other housing and then the cam groove of either one housing of the first connector or of the second connector starts to slide in the first cam-projection of the slider.

As further sliding the second cam-projection along the cam portion, the complete coupling between the first connector, which has been accommodated in the frame by the slide of the first cam-projection along the connector coupling cam groove of the cam groove, and the second connector is attained. And simultaneously, the completely coupled first and second connectors are allowed to move in the uncoupling direction by the slide of the first cam-projection in the shift-allowing cam groove of the cam groove.

As a third modified embodiment of the aforementioned LIF connector 21, the cam groove is formed on one of the up-and-down side walls of either one housing of the first connector or of the second connector and the cam-engaging slit applied to the first modified embodiment is formed on the other housing of the first connector or of the second connector. And, the frame is provided with the second cam-projection and the slider is provided with the first cam-projection and the cam portion.

With this structure, when the second cam-projection of the frame slides along the cam portion of the slider, the slider shifts through the cam-engaging slit of the other housing and then the cam groove of either one housing of the first connector or of the second connector starts to slide in the first cam-projection of the slider.

As further sliding the second cam-projection along the cam portion, the complete coupling between the first connector, which has been accommodated in the frame by the slide of the first cam-projection along the connector coupling cam groove of the cam groove, and the second connector is attained. And simultaneously, the completely coupled first and second connectors are allowed to move in the uncoupling direction by the slide of the first cam-projection in the shift-allowing cam groove of the cam groove.

The above-described modified embodiments of the LIF connector 21 exhibits the same effects as the LIF connector 21.

Like the LIF connector 21, each of the above-described modified embodiments preferably has pairs of the first cam-projections, the second cam-projections, the cam portions, and the cam grooves as the coupling promoting portion for stability of the coupling between the first connector and the second connector.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A low insertion force connector, comprising:

a first connector;

a second connector to be coupled with said first connector; and two kinds of coupling operation members slidably mounted on one of said first connector and said second connector, wherein one of said two kinds of coupling operation members slides relative to the other coupling operation member to promote coupling of said first connector and said second connector and enable said first connector and said second connector in a state of complete coupling to move in an uncoupling direction thereof.

2. The low insertion force connector according to claim 1, wherein each of said first connector, said second connector and said two kinds of coupling operation members is provided with a coupling promoting portion to promote coupling of said first connector and said second connector.

3. The low insertion force connector according to claim 2, wherein said first connector, said second connector, and said two kinds of coupling operation members each have two of said coupling promoting portion.

4. A low insertion force connector, comprising:

a first connector:

a second connector to be coupled with said first connector; and two kinds of coupling operation members which act on each other, promote coupling of said first connector and said second connector and enable said first connector and said second connector in a state of complete coupling to move in an uncoupling direction thereof, wherein each of said first connector, said second connector and said two kinds of coupling operation members is provided with a coupling promoting portion to promote coupling of said first connector and said second connector, wherein said coupling promoting portion of one of said two kinds of coupling operation members is provided with a cam groove having a connector coupling cam groove, with which said coupling promoting portion of one of said first and said second connectors slidingly engages until said complete coupling of said first and said second connectors, and a shift-allowing cam groove extending from said connector coupling cam groove in a direction orthogonal to said uncoupling direction and enabling said first and said second connectors in said completely coupled state to move in said uncoupling direction.

5. The low insertion force connector according to claim 4, wherein said two kinds of coupling operation members consist of a slider having said cam groove and mounted on said coupling promoting portion of the other one of said first said second connectors and a frame to accommodate said first and said second connectors in said completely coupled state movably in said uncoupling direction and to drive said slider.

6. The low insertion force connector according to claim 5, wherein said coupling promoting portion of the other one of said first and said second connectors is formed to enable said slider to slide in a direction orthogonal to said uncoupling direction at the beginning of coupling of said first and said second connectors.

7. The low insertion force connector according to claim 6, wherein said coupling promoting portion of the other one of said first and said second connectors is a cam-engaging slit formed on a housing of the other one of said first and said second connectors.

8. A low insertion force connector, comprising:

a first connector;

a second connector to be coupled with said first connector; and a coupling operation member which promotes coupling of said first connector and said second connector and enables said first connector and said second connector in a state of complete coupling to move in an uncoupling direction thereof, wherein each of said first connector, said second connector and said coupling operation member is provided with a coupling promoting portion to promote coupling of said first connector and said second connector, wherein said coupling promoting portion of said coupling operation member is provided with a cam groove having a connector coupling cam groove, with which said coupling promoting portion of one of said first and said second connectors slidingly engages until said complete coupling of said first and said second connectors, and a shift-allowing cam groove extending from said connector coupling cam groove in a direction orthogonal to said uncoupling direction and enabling said first and said second connectors in said completely coupled state to move in said uncoupling direction, wherein said coupling operation member consists of a slider having said cam groove and mounted on said coupling promoting portion of the other one of said first said second connectors and a frame to accommodate said first and said second connectors in said completely coupled state movably in said uncoupling direction and to drive said slider, and wherein said coupling promoting portion of one of said first and said second connectors is a first cam-projection projecting from a housing of said one of said first and said second connectors, a coupling promoting portion of said slider is a second cam-projection to make said first cam-projection slidingly engage said cam groove, and a coupling promoting portion of said frame is a cam portion to slidingly engage said second cam-projection.

9. A low insertion force connector, comprising:

a first connector;

a second connector to be coupled with said first connector; and a coupling operation member which promotes coupling of said first connector and said second connector and enables said first connector and said second connector in a state of complete coupling to move in an uncoupling direction thereof, wherein each of said first connector, said second connector and said coupling operation member is provided with a coupling promoting portion to promote coupling of said first connector and said second connector, wherein said coupling promoting portion of said coupling operation member is provided with a cam groove having a connector coupling cam groove, with which said coupling promoting portion of one of said first and said second connectors slidingly engages until said complete coupling of said first and said second connectors, and a shift-allowing cam groove extending from said connector coupling cam groove in a direction orthogonal to said uncoupling direction and enabling said first and said second connectors in said completely coupled state to move in said uncoupling direction, and wherein said coupling promoting portion of one of said first and said second connectors is a first cam-projection projecting from a housing of said one of said first and said second connectors, a coupling promoting portion of said frame is a second cam-projection to make said first cam-projection slidingly engage said cam groove, and a coupling promoting portion of said slider is a cam portion to slidingly engage said second cam-projection.

10. A low insertion force connector, comprising:

a first connector;

a second connector to be coupled with said first connector; and two kinds of coupling operation members which act on each other, promote coupling of said first connector and said second connector and enable said first connector and said second connector in a state of complete coupling to move in an uncoupling direction thereof, wherein each of said first connector, said second connector and said two kinds of coupling operation members is provided with a coupling promoting portion to promote coupling of said first connector and said second connector, wherein said coupling promoting portion of one of said first and said second connectors is provided with a cam groove having a connector coupling cam groove, with which said coupling promoting portion of one of said two kinds of coupling operation members slidingly engages until said complete coupling of said first and said second connectors, and a shift-allowing cam groove extending from said connector coupling cam groove in a direction orthogonal to said uncoupling direction and enabling said first and said second connectors in said completely coupled state to move in said uncoupling direction.

11. The low insertion force connector according to claim 10, wherein said two kinds of coupling operation members consist of a slider having a coupling promoting portion corresponding to said cam groove and mounted on said coupling promoting portion of the other one of said first said second connectors and a frame to accommodate said first and said second connectors in said completely coupled state movably in said uncoupling direction and to drive said slider.

12. A low insertion force connector, comprising:

a first connector:

a second connector to be coupled with said first connector; and a coupling operation member which promotes coupling of said first connector and said second connector and enables said first connector and said second connector in a state of complete coupling to move in an uncoupling direction thereof, wherein each of said first connector, said second connector and said coupling operation member is provided with a coupling promoting portion to promote coupling of said first connector and said second connector, wherein said coupling promoting portion of one of said first and said second connectors is provided with a cam groove having a connector coupling cam groove, with which said coupling promoting portion of said coupling operation member slidingly engages until said complete coupling of said first and said second connectors, and a shift-allowing cam groove extending from said connector coupling cam groove in a direction orthogonal to said uncoupling direction and enabling said first and said second connectors in said completely coupled state to move in said uncoupling direction, wherein said coupling operation member consists of a slider having a coupling promoting portion corresponding to said cam groove and mounted on said coupling promoting portion of the other one of said first said second connectors and a frame to accommodate said first and said second connectors in said completely coupled state movably in said uncoupling direction and to drive said slider, and wherein said coupling promoting portion of said slider is provided with a first cam-projection to slidingly engage said cam groove and a second cam-projection to make said first cam-projection slidingly engage said cam groove, and a coupling promoting portion of said frame is a cam portion to slidingly engage said second cam-projection.

13. A low insertion force connector, comprising:

a first connector;

a second connector to be coupled with said first connector; and a coupling operation member which promotes coupling of said first connector and said second connector and enables said first connector and said second connector in a state of complete coupling to move in an uncoupling direction thereof, wherein each of said first connector, said second connector and said coupling operation member is provided with a coupling promoting portion to promote coupling of said first connector and said second connector.

wherein said coupling promoting portion of one of said first and said second connectors is provided with a cam groove having a connector coupling cam groove, with which said coupling promoting portion of said coupling operation member slidingly engages until said complete coupling of said first and said second connectors, and a shift-allowing cam groove extending form said connector coupling cam groove in a direction orthogonal to said uncoupling direction and enabling said first and said second connectors in said completely coupled state to move in said uncoupling direction, wherein said coupling operation member consists of a slider having a coupling promoting portion corresponding to said cam groove and mounted on said coupling promoting portion of the other one of said first said second connectors and a frame to accommodate said first and said second connectors in said completely coupled state movably in said uncoupling direction and to drive said slider, wherein said coupling promoting portion of said slider is provided with a first cam-projection to slidingly engage said cam groove and a second cam-projection to make said first cam-projection slidingly engage said cam groove, and a coupling promoting portion of said frame is a cam portion to slidingly engage said second cam-projection, and wherein said coupling promoting portion of said slider is provided with a first cam-projection to slidingly engage said cam groove and a cam portion, and a coupling promoting portion of said frame is a second cam-projection to slidingly engage said cam portion and to thereby make said first cam-projection slidingly engage said cam groove.

14. The low insertion force connector according to claim 5 or claim 11, wherein said first connector is provided with a sliding strip and said frame is provided with a sliding groove which engages said sliding strip so as to guide said first connector in an axial direction.

15. The low insertion force connector according to claim 5 or claim 11, wherein said first connector is provided with an engaging projection and said frame is provided with a n engaging nail so as to engage said first connector with said frame on coupling of said first connector and said second connector by making said engaging projection abut against said engaging nail.

16. The low insertion force connector according to any one of claims 11–13, wherein said coupling promoting portion of the other one of said first and said second connectors is formed to enable said slider to slide in a direction orthogonal to said uncoupling direction at the beginning of coupling of said first and said second connectors.

17. The low insertion force connector according to claim 16, wherein said coupling promoting portion of the other one of said first and said second connectors is a cam-engaging slit formed on a housing of the other one of said first and said second connectors.

* * * * *

UNITED STATES PATENT AND TRADEMARK OFFICE

CERTIFICATE OF CORRECTION

PATENT NO. : 6,382,991 B2
DATED : May 7, 2002
INVENTOR(S) : Kumakura et al.

It is certified that error appears in the above-identified patent and that said Letters Patent is hereby corrected as shown below:

Title page,
Item [*], Notice, “by 0 days” should be -- by 1 day --

Signed and Sealed this

Third Day of June, 2003

JAMES E. ROGAN
*Director of the United States Patent and Trademark Office*